US007588355B1

(12) United States Patent
Liu et al.

(10) Patent No.: US 7,588,355 B1
(45) Date of Patent: Sep. 15, 2009

(54) LED LAMP ASSEMBLY

(75) Inventors: You-Xue Liu, Shenzhen (CN); Li He, Shenzhen (CN); Tsung-Lung Lee, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/050,960

(22) Filed: Mar. 19, 2008

(51) Int. Cl.
*F21V 29/00* (2006.01)

(52) U.S. Cl. ..... 362/373; 362/240; 362/294

(58) Field of Classification Search ..... 362/236, 362/237, 240, 241, 247, 294, 373, 546–545, 362/574

See application file for complete search history.

(56) References Cited

U.S. PATENT DOCUMENTS

| | | | | |
|---|---|---|---|---|
| 6,908,214 | B2 * | 6/2005 | Luk | 362/250 |
| 7,014,337 | B2 * | 3/2006 | Chen | 362/240 |
| 7,237,936 | B1 * | 7/2007 | Gibson | 362/547 |
| 2006/0092639 | A1 * | 5/2006 | Livesay et al. | 362/294 |
| 2007/0115656 | A1 * | 5/2007 | Chou et al. | 362/228 |

* cited by examiner

*Primary Examiner*—Laura Tso
(74) *Attorney, Agent, or Firm*—Frank R. Niranjan

(57) ABSTRACT

An LED lamp assembly includes a receiving member and a pair of LED lamps. The receiving member has a pair of opposite slope surfaces. The LED lamps are mounted on the opposite slope surfaces of the receiving member. Each of the LED lamps includes a heat sink having a bottom defining a plurality of differently-angled planar surfaces. A plurality of LED modules is mounted on the planar surfaces of the heat sink, respectively.

13 Claims, 4 Drawing Sheets

LED LAMP ASSEMBLY

BACKGROUND OF THE INVENTION

1. Field of the Invention

The present invention relates to an LED lamp assembly, and more particularly to an LED lamp assembly having a large illumination angle.

2. Description of Related Art

The technology of light emitting diodes has rapidly developed in recent years from indicators to illumination applications. With the features of long-term reliability, environment friendliness and low power consumption, the LED is viewed as a promising alternative for future lighting products.

A conventional LED lamp comprises a heat sink and a plurality of LED modules having LEDs attached to an outer surface of a heat sink to dissipate heat generated by the LEDs. The outer surface of the heat sink generally is a plane and the LEDs are arranged close to each other. When the LED lamp works, the LEDs mounted on the planar outer surface of the heat sink only form a flat light source.

What is needed, therefore, is an LED lamp assembly having a large illumination angle.

SUMMARY OF THE INVENTION

An LED lamp assembly includes a receiving member and a pair of LED lamps. The receiving member has a pair of opposite slope surfaces. The LED lamps are mounted on the opposite slope surfaces of the receiving member. Each of the LED lamps includes a heat sink and a plurality of LED modules mounted on the heat sink. The heat sink has a plurality of differently-angled planar surfaces at a bottom thereof. The LED modules are mounted to the planar surfaces, respectively. The slope surfaces are tilted outwardly along top-to-bottom direction and tilted outwardly along front-to-rear direction.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
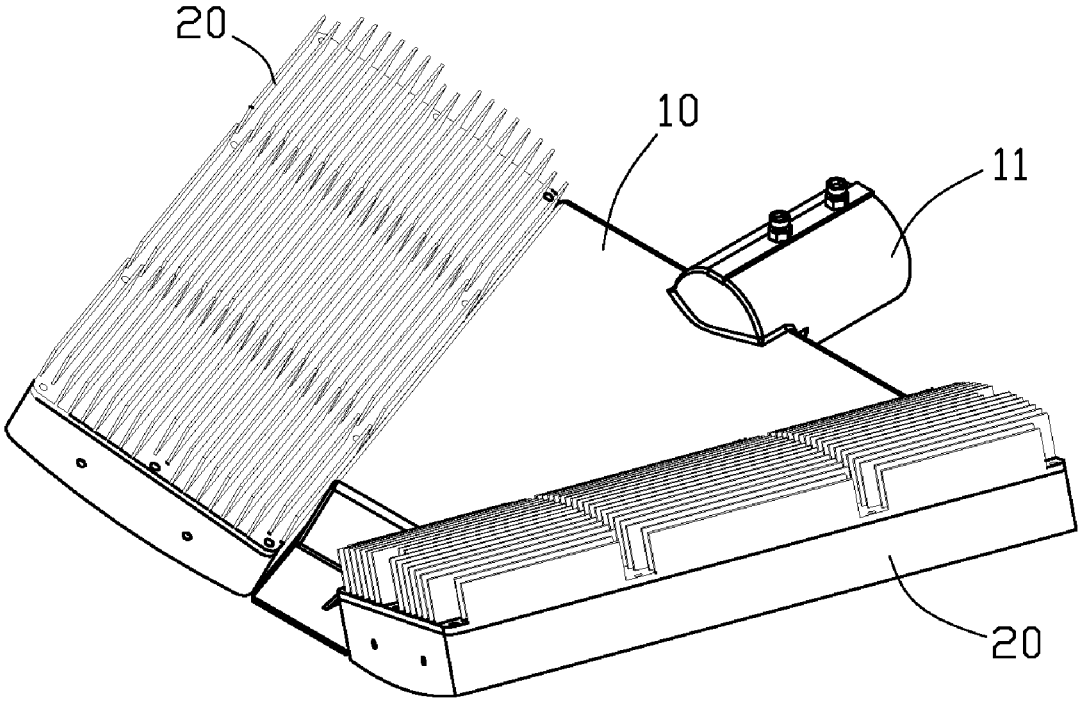
FIG. 1 is an assembled view of an LED lamp assembly in accordance with a preferred embodiment of the present invention.

Referring to FIG. 1, an LED lamp assembly (not labeled) comprises a receiving member 10 and a pair of LED lamps 20 assembled on opposite sides of the receiving member 10. A driving circuit module (not labeled) is received in the receiving member 10 to electronically connect with and supply power to the LED lamps 20.

Figure 2:
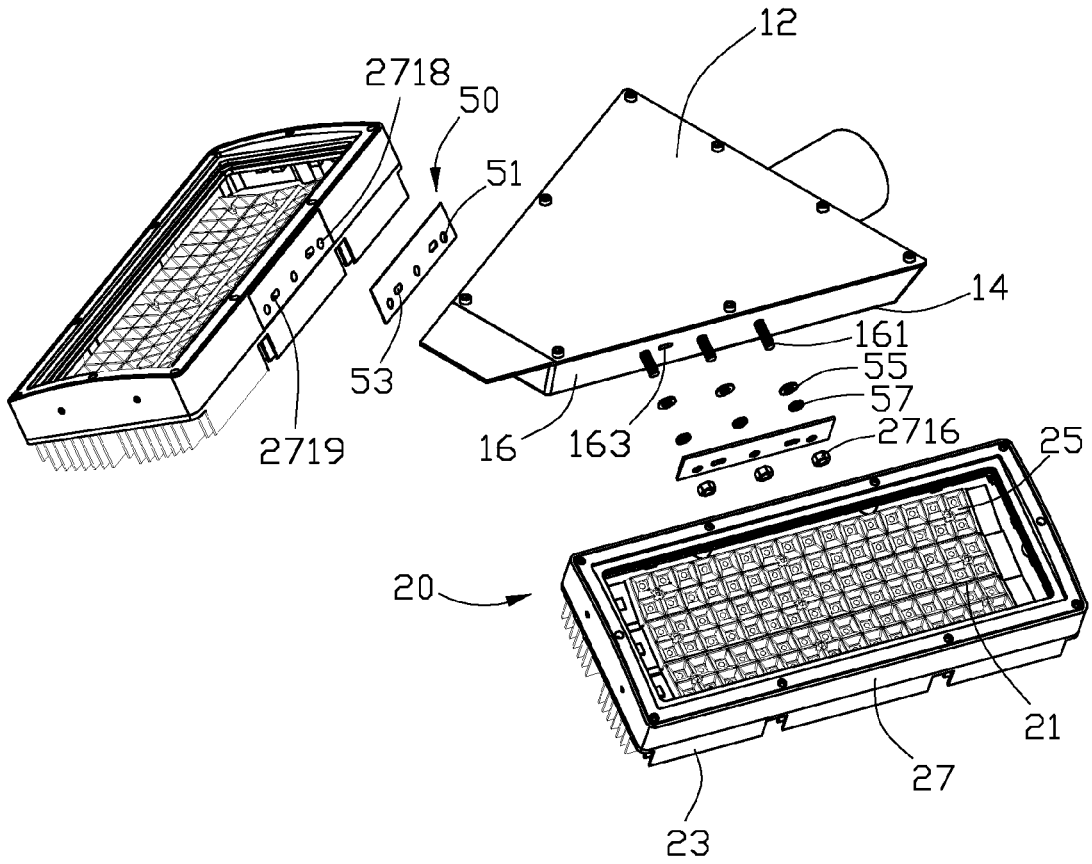
FIG. 2 is an exploded view of FIG. 1, but viewed from a different aspect.

Referring to FIG. 2, the receiving member 10 has a triangular configuration and consists of a top surface 14, a bottom surface 12 opposite to the top surface 14, a pair of mounting surfaces 16 connecting right and left edges of the top and bottom surfaces 14, 12, and a rear surface (not labeled) and a front surface (not labeled) connecting rear and front edges of the top and bottom surfaces 14, 12 respectively. A lamp holder 11 is secured to the rear surface of the LED lamp assembly. The lamp holder 11 is provided for securely connecting with a supporting post (not shown) whereby the LED lamp assembly can be supported by the supporting post. The bottom surface 12 and the top surface 14 are trapeziform and parallel to each other. The bottom surface 12 has a slightly larger area than that of the top surface 14; thus, the mounting surfaces 16 extend outwardly and downwardly from the edges of the top surface 14 to the edges of the bottom surface 12. In addition, the rear surface is larger than the front surface; thus, the mounting surfaces 16 extend outwardly and rearwards from the front surface to the rear surface. Three spaced elongated screws 161 extend outwardly from each of the mounting surfaces 16 to be engaged with the LED lamps 20. A pair of through holes 163 (only one shown) is defined in the mounting surfaces 16 for extension of electric wires from the driving circuit board through the mounting surfaces 16 to enter the LED lamps 20.

Each LED lamp 20 comprises a plurality of LED modules 21, a heat sink 23 supporting and cooling the LED modules 21, a plurality of reflectors 25 over the LED modules 21, and a housing 27 mounted around a periphery of the heat sink 23 to enclose the LED modules 21 and the reflectors 25 therein.

Figure 3:
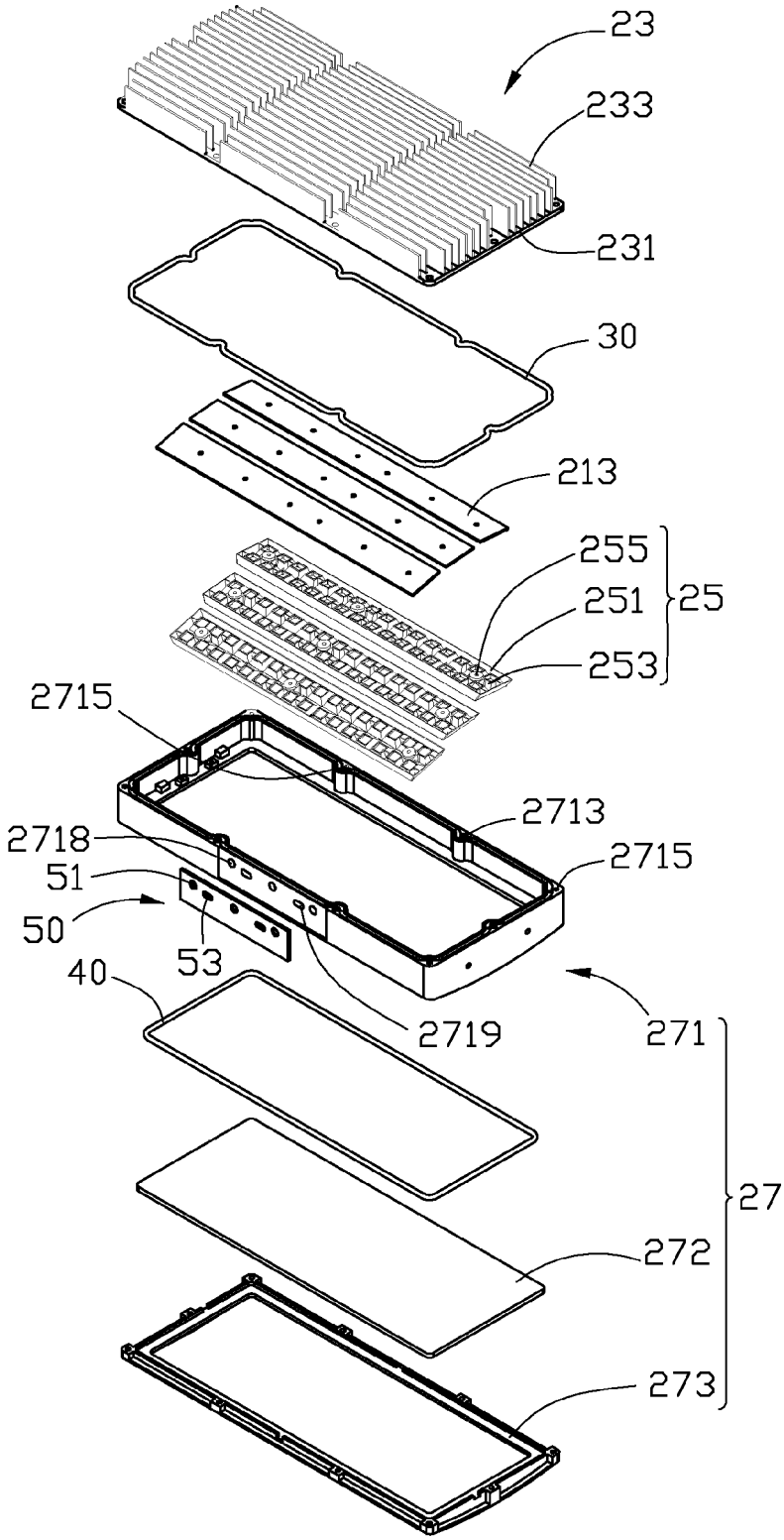
FIG. 3 is an exploded view of an LED lamp of FIG. 1.
Figure 4:
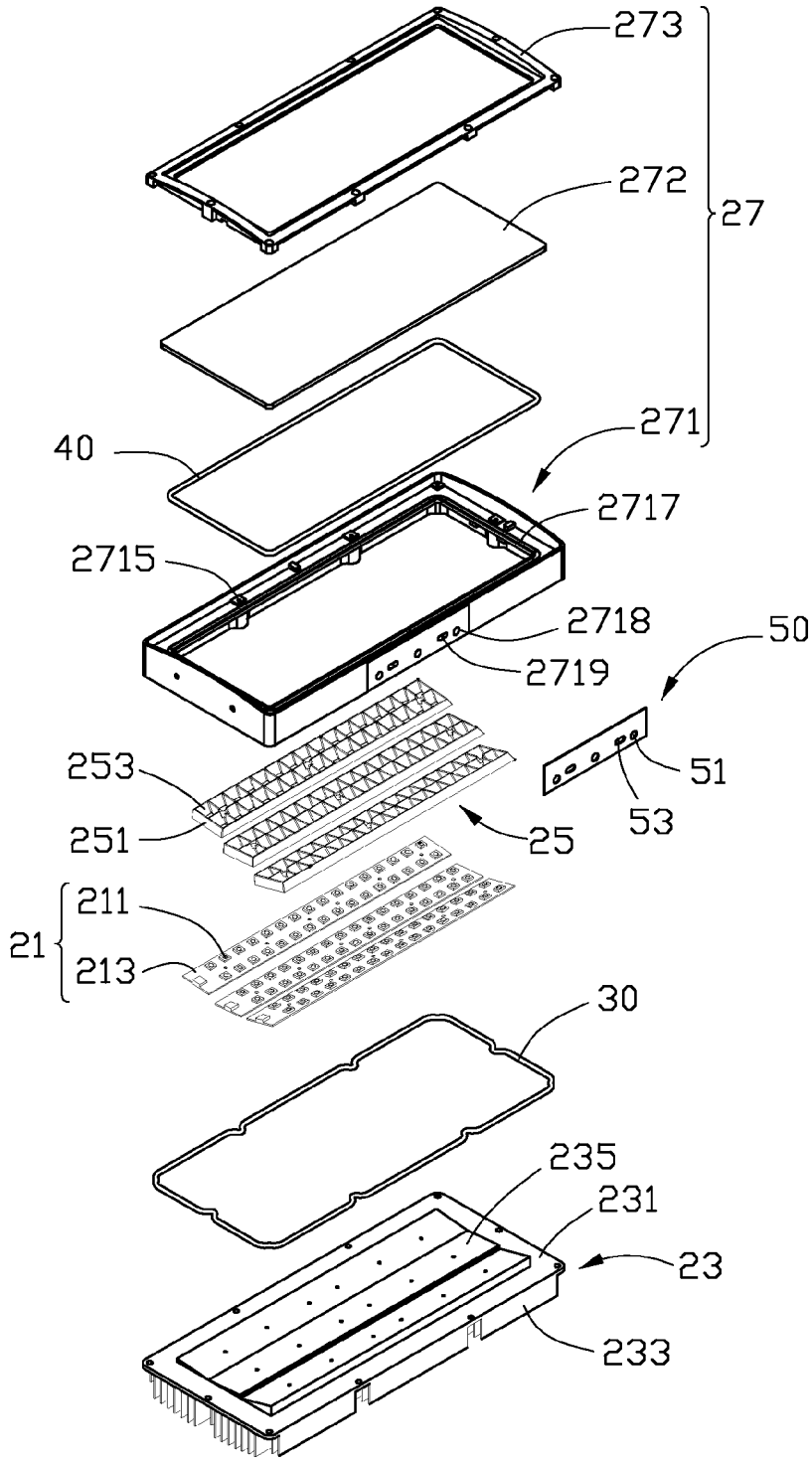
FIG. 4 is an inverted view of FIG. 3.

Referring to FIGS. 3-4, the heat sink 23 is made of a metal with a high degree of heat conductivity, such as copper or aluminum. The heat sink 23 comprises a rectangular base 231 and a plurality of fins 233 extending from the base 231. The base 231 comprises a top surface (not labeled) and a bottom surface (not labeled) opposite to the top surface. The fins 233 extend from the top surface of the base 231. A centre of the bottom surface of the base 231 protrudes three elongated planar surfaces 235. The LED modules 21 are attached on the surfaces 235. The surfaces 235 are angled with each other.

Each LED module 21 comprises an elongated printed circuit board 213 and a plurality of spaced LEDs 211 evenly mounted on a side of the printed circuit board 213. The LEDs 211 of each LED module 21 are arranged along a longitudinal direction of the printed circuit board 213. Each LED module 21 is mounted in a thermally conductive relationship with the bottom surface of the heat sink 23 and electronically connects with the driving circuit module.

Each reflector 25 is located over the printed circuit board 213 of a corresponding LED module 21. The reflector 25 comprises a rim 251 and a plurality of ribs (not labeled) within the rim 251. The rim 251 and the ribs connect with each other to define a plurality of through holes 253. The LEDs 211 are received in the through holes 253, respectively. Light generated by the LEDs 211 is reflected by the reflectors 25 to increase the intensity of the light emitted from the LED lamps 20. A plurality of sleeves 255 is formed in the reflector 25 along a thickness direction thereof. A plurality of screws (not shown) are used to extend through the sleeves 255 and the printed circuit boards 213 to engage with the heat sink 23 thereby to mount the reflectors 25 and the LED modules 21 on the heat sinks 23.

The housing 27 comprises a rectangular frame 271 engaging with the heat sink 23, a transparent cover 272 enclosed in the frame 271 and covering a bottom opening (not labeled) of the frame 271, and a rectangular fixture 273 located at a bottom of the frame 271 and mounting the cover 272 on the frame 271.

The frame 271 forms a plurality of protruding portions 2713 on inner surfaces thereof. Each protruding portion 2713 and each corner of the frame 271 define a screw hole 2715 therein. Screws (not shown) extend through the heat sink 23 and engage into a top portion of the screw holes 2715 to mount the frame 271 on the heat sink 23. The LED modules 21 are enclosed in the frame 271. A rectangular ring-shaped gasket 30 is sandwiched between the frame 271 and the heat sink 23 to enhance hermeticity of the connection between the frame 271 and the heat sink 23. A plurality of connecting plates (not labeled) extends inwardly from bottom of the inner surfaces of the frame 271. A plurality of supporting plates 2717 extends inwardly and downwardly from edges of the connecting plates to support the cover 272. The fixture 273 presses the cover 272 against the supporting plates 2717. Screws (not shown) extend through the fixture 273 and engage into a bottom portion of the screw holes 2715 to mount the fixture 273 on the frame 271. A rectangular ring-shaped gasket 40 is sandwiched between the cover 273 and the supporting plates 2717 to enhance hermeticity of the connection between the cover 273 and the supporting plates 2717. A centre of an elongated sidewall (not labeled) of the frame 271 defines three holes 2718 corresponding to the elongated screws 161 of the receiving member 10. A nut 2716 is received in each of the holes 2718 to engage with the elongated screws 161. Two through holes 2719 are defined between the holes 2718 for extension of the electric wires from the driving circuit module into the LED lamp 20.

A rectangular linking plate 50 is sandwiched between the elongated sidewall of the LED lamp 20 and the mounting surface 16 of the receiving member 10. The linking plate 50 defines three mounting holes 51 corresponding to the holes 2718 of the frame 271 of the LED lamp 20, and two holes 53 corresponding to the through holes 2719 of the frame 271 of the LED lamp 20. The elongated screws 161 extend through the mounting holes 51 of the linking plates 50, O-rings 55, 57 to threaded engage with the nuts 2716 in the holes 2718 of the frame 271, thereby to mount the LED lamps 20 on the opposite sides of the receiving member 10. In this state, the heat sinks 23 extend outwardly and upwardly from the mounting surfaces 16 of the receiving member 10, as shown in FIG. 1. By the provision of the mounting surfaces 16 which are titled outwardly along top-to-bottom direction and tilted outwardly along front-to-rear direction, and the provision of the differently-angled planar surfaces 235 at the bottom the of the heat sinks 23, the LED modules 21 are oriented toward a plurality of different directions, whereby the LED lamp assembly in accordance with the present invention can have a large illumination angle. In addition, since the LED modules 21 have an intimate contact with the heat sinks 23, the heat generated by the LEDs 211 can be timey dissipated to surrounding air by the fins 233 of the heat sinks 23. Thus, the LED lamp assembly can work normally when the LEDs 211 are activated.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp assembly comprising:

a receiving member having a pair of opposite slope surfaces; and a pair of LED lamps mounted on the opposite slope surfaces of the receiving member, each of the LED lamps comprising a heat sink and a plurality of LED modules mounted on the heat sink;

wherein a pair of linking plates are sandwiched between the LED lamps and the opposite slope surfaces of the receiving member respectively.

2. The LED lamp assembly as claimed in claim 1, wherein the receiving member has a triangular configuration and consists of a top surface, and a bottom surface, the bottom surface and the top surface are trapeziform and parallel to each other, the bottom surface is large than the top surface, the slope surfaces extend outwardly and downwardly from edges of the top surface to edges of the bottom surface.

3. The LED lamp assembly as claimed in claim 2, wherein the LED lamps extend slantwise and upwardly from the slope surfaces.

4. The LED lamp assembly as claimed in claim 1, wherein the heat sink comprises a base, the base comprising a bottom surface, a centre of the bottom surface of the base protruding a plurality of protruded portions, and wherein each of the protruded portions has an elongated planar surface, the planar surfaces of the protruded portions are connected each other in series, and two adjacent planar surfaces angled with each other and the LED modules are attached on the elongated planar surfaces, respectively.

5. The LED lamp assembly as claimed in claim 2, wherein each of the LED lamps comprises a plurality of reflectors over the LED modules, respectively, the reflectors being secured to the heat sink.

6. The LED lamp assembly as claimed in claim 5, wherein a housing engages with a bottom portion of the heat sink to enclose the LED modules and the reflectors therein.

7. The LED lamp assembly as claimed in claim 6, wherein the housing comprises a rectangular frame engaging with the heat sink, a transparent cover enclosed in the frame and covering an opening of the frame, and a rectangular fixture located at a bottom of the frame and mounting the cover on the frame.

8. The LED lamp assembly as claimed in claim 7, wherein a pair of gaskets is respectively sandwiched between the heat sink and the frame and between the frame and the cover.

9. The LED lamp assembly as claimed in claim 1, wherein a plurality of screws extends outwardly from the opposite slope surfaces of the receiving member through the linking plates to engage in nuts received in the LED lamps to thereby mount the LED lamps on the opposite slope surfaces of the receiving member.

10. An LED lamp assembly comprising:

a receiving member, wherein the receiving member has a triangular configuration and consists of a top surface, a bottom surface opposite to the top surface and a pair of opposite mounting surfaces connecting edges of the top and bottom surfaces; and a pair of LED lamps mounted on the mounting surfaces of the receiving member, the LED lamps extending slantwise and upwardly from the opposite sides of the receiving member, each of the LED lamps comprising a heat sink and a plurality of LED modules mounted on the heat sink.

11. The LED lamp assembly as claimed in claim 10, wherein a distance between the two opposite mounting surfaces is gradually increased from a front end to a rear end of the two mounting surfaces.

12. The LED lamp assembly as claimed in claim 10, wherein the receiving member has a trapeziform cross section, a length of the cross section at bottom is larger than a length of the cross section at top.

13. An LED lamp assembly comprising:

a receiving member having two opposite lateral surfaces, the opposite lateral surfaces being titled outwardly along top-to-bottom direction and being tilted outwardly along front-to-rear direction;

a lamp holder secured to a rear surface of the receiving member, adapted for connecting with a supporting post; and two LED lamps mounted to the two opposite lateral surfaces of the receiving member, respectively, each LED lamp having a heat sink having a bottom forming a plurality differently-angled planar surfaces, and a plurality of LED modules mounted on the planar surfaces, respectively.

* * * * *